US008037581B2

(12) United States Patent
Gray et al.

(10) Patent No.: US 8,037,581 B2
(45) Date of Patent: Oct. 18, 2011

(54) ANTI-RATTLE TONGUE PLATE AND METHOD OF FORMING SAME

(75) Inventors: Mark F. Gray, Sterling Heights, MI (US); Timothy A. Gandee, Washington, MI (US)

(73) Assignee: TK Holdings, Inc., Auburn Hills, MI (US)

( * ) Notice: Subject to any disclaimer, the term of this patent is extended or adjusted under 35 U.S.C. 154(b) by 1014 days.

(21) Appl. No.: 11/457,313

(22) Filed: Jul. 13, 2006

(65) Prior Publication Data

US 2009/0179412 A1 Jul. 16, 2009

Related U.S. Application Data

(60) Provisional application No. 60/698,695, filed on Jul. 13, 2006.

(51) Int. Cl.
*A44B 11/00* (2006.01)
*G60R 22/24* (2006.01)

(52) U.S. Cl. ..... 24/163 R; 24/176; 24/197; 24/198; 24/593.1; 24/633; 24/DIG. 51; 280/801.1; 280/808; 297/483

(58) Field of Classification Search ..... None
See application file for complete search history.

(56) References Cited

U.S. PATENT DOCUMENTS

| | | | | |
|---|---|---|---|---|
| 4,527,313 | A * | 7/1985 | Sylven et al. | 24/464 |
| 6,526,630 | B2 * | 3/2003 | Suzuki et al. | 24/265 BC |
| 6,837,519 | B2 * | 1/2005 | Moskalik et al. | 280/801.1 |
| 2003/0234530 | A1 * | 12/2003 | Moskalik et al. | 280/801.1 |
| 2007/0050953 | A1 * | 3/2007 | Versellie et al. | 24/265 R |

OTHER PUBLICATIONS http://www.machinist-materials.com/comparison_table_for_plastics.htm.* www.machinist-materials.com/comparison_table_for_plastics.htm. 2001.*

* cited by examiner

*Primary Examiner* — Jack W. Lavinder
(74) *Attorney, Agent, or Firm* — Fitch Even Tabin & Flannery

(57) ABSTRACT

An anti-rattle tongue plate is provided that includes two different materials for being operably connected to the body of the tongue plate. One of the materials is softer than the other to minimize noise when the tongue plate engages against interior components of the vehicle such as during rough ride conditions. One of the materials is made into a distinct component for being operably connected to the tongue plate body. In this manner, the tongue plate herein eliminates at least one of the insert molds needed for prior over molded latch plates, thus providing manufacturing and cost efficiencies thereover.

7 Claims, 12 Drawing Sheets

ANTI-RATTLE TONGUE PLATE AND METHOD OF FORMING SAME

FIELD OF THE INVENTION

The invention relates to a tongue plate for a seat belt system and, more particularly to a tongue plate having an anti-rattle construction and a method for forming such tongue plates.

BACKGROUND OF THE INVENTION

Tongue plates that latch into buckles for securing a seat belt about an occupant of a vehicle seat are usually made from a stamped metal plate having an elongate, laterally extending opening in a wide portion of a plate body for the seat belt webbing. There is also a narrower, centrally projecting portion of the tongue plate body that has an opening for being latched in the buckle. In many seat belt systems, the tongue plate typically is positioned between the side trim of the vehicle and the outboard side of the vehicle seat when in the unlatched or stowed condition. In some recent model vehicles there has been a gradual reduction in the amount of space between the side of the vehicle seat and the side trim of the vehicle interior. Accordingly, when the vehicle is undergoing rough ride conditions, the tongue plate is more likely to shake and vibrate on the belt webbing and engage against the hard side trim panel in the vehicle interior generating undesirable noise in the vehicle compartment.

U.S. Pat. No. 6,837,519 to Moskalik et al. is directed to a construction for a tongue or latch plate for sound reduction. In the '519 patent, a latch plate has a coating of hard plastic material over molded onto the plate. Thereafter, while the hard plastic is warm, a soft plastic is over molded onto the warm, hard plastic material on the plate. While providing noise reduction, over molding two coatings of plastic material onto the latch plate undesirably increases manufacturing costs for the latch plate. In this regard, two insert molds need to be employed into which the operator has to manually load the part onto which the over mold is to be applied. So in the latch plate disclosed by the '519 patent, there is a first insert mold in which the operator places the plate body for having the hard plastic over molded thereon. Thereafter, with the hard plastic still warm, the operator removes the plate body with the warm over mold of hard plastic, and places it in the next insert mold. This insert mold is then cycled for over molding the soft plastic material onto the warm, hard plastic material. As is apparent, the two insert molds require significant operator intervention for generating the over molded latch plate of the '519 patent.

Accordingly, there is a need for an anti-rattle tongue plate with a more efficient construction. More particularly, an anti-rattle tongue plate that provides manufacturing and attendant cost efficiencies would be desirable.

SUMMARY OF THE INVENTION

In one aspect of the present invention, an anti-rattle tongue plate is provided that includes two different materials for being operably connected to the body of the tongue plate. One of the materials is softer than the other to minimize noise when the tongue plate engages against interior components of the vehicle such as during rough ride conditions. One of the materials is made into a distinct component for being operably connected to the tongue plate body. In this manner, the tongue plate herein eliminates at least one of the insert molds needed for the over molded latch plate of the '519 patent, thus providing manufacturing and cost efficiencies thereover.

In a preferred form, the distinct component is a hard insert that is first applied to the plate body, and the softer material is over molded onto predetermined locations of the plate body, the hard insert, or both. The hard insert can be retained on the plate body in a variety of ways. In one form, there is a groove formed in the insert into which the plate body is fit. Thereafter, the over molded soft material is utilized to fix the hard insert in place on the plate body against removal therefrom. Alternatively, or in addition to or as part of the groove, the hard insert can have a press or snap fit to the plate body.

In another form, the distinct component is of the softer material, and it is the harder material that is initially over molded onto the plate body. The distinct component can be a band of resilient material and, in a preferred form, the band and over molded hard material are configured so that the band is resiliently retained on the over molded hard material. Such configuration can take the form of a peripheral groove in the over molded hard material with the band having a thin elongate construction for providing a snug fit in the groove with a portion of the band projecting out therefrom.

In yet another form, the soft material can be initially over molded onto the plate body. Thereafter, an insert of hard material is then press or snap fit to the soft over molded material, the plate body, or both.

DETAILED DESCRIPTION OF THE PREFERRED EMBODIMENTS

Figure 1:
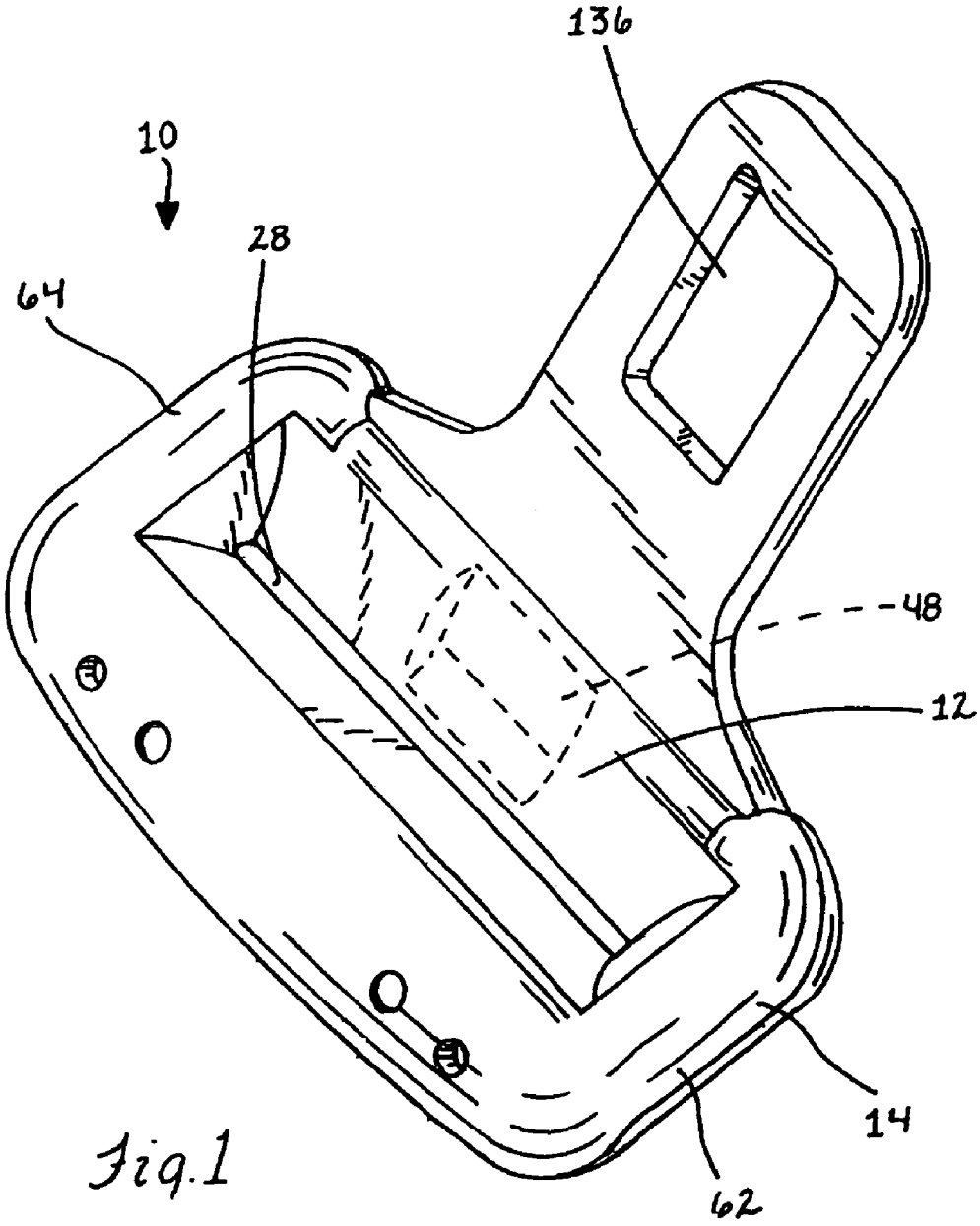
FIG. 1 is a perspective view of a tongue plate in accordance with one form of the present invention showing a body of the plate having a hard insert and a soft over mold.
Figure 2:
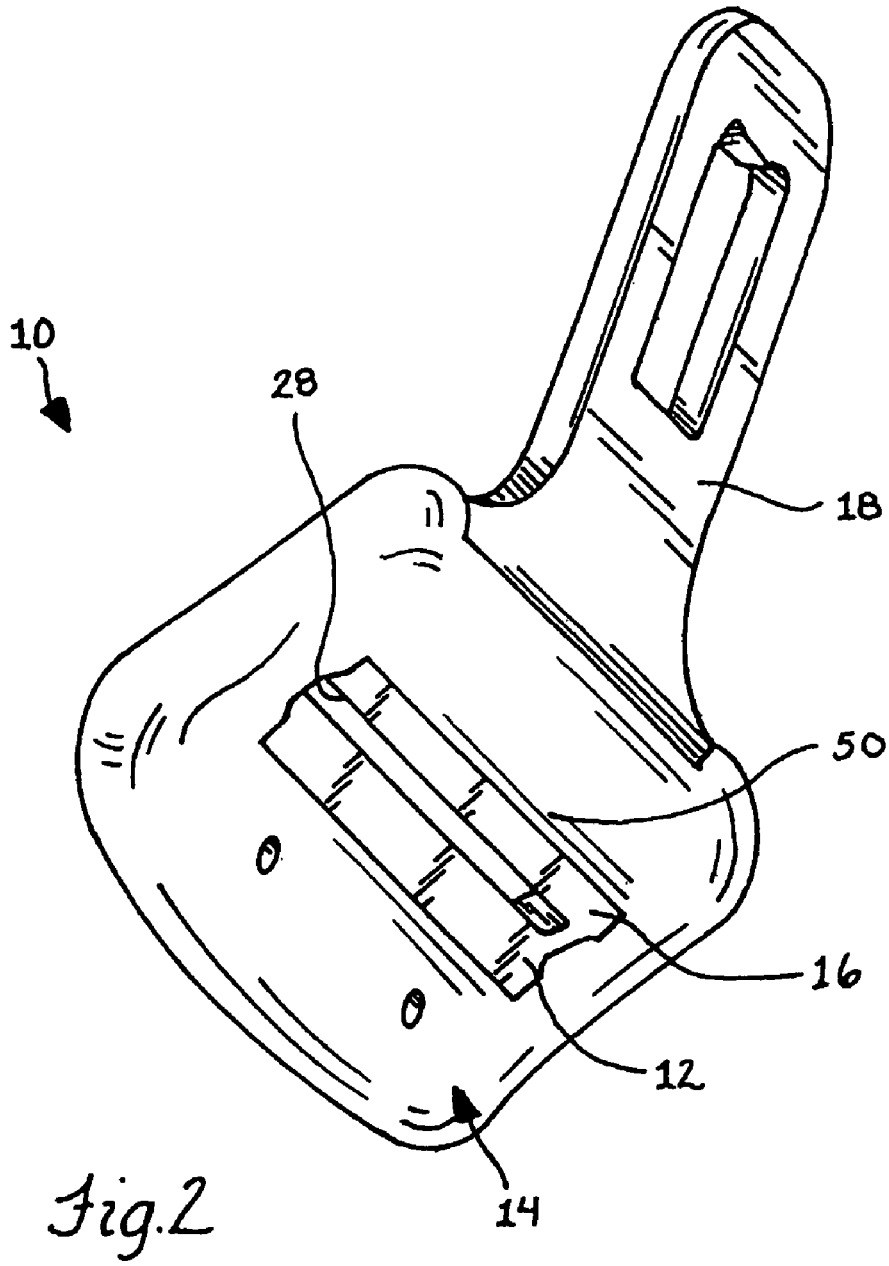
FIG. 2 is a rear perspective view of the tongue plate of FIG. 1.
Figure 3:
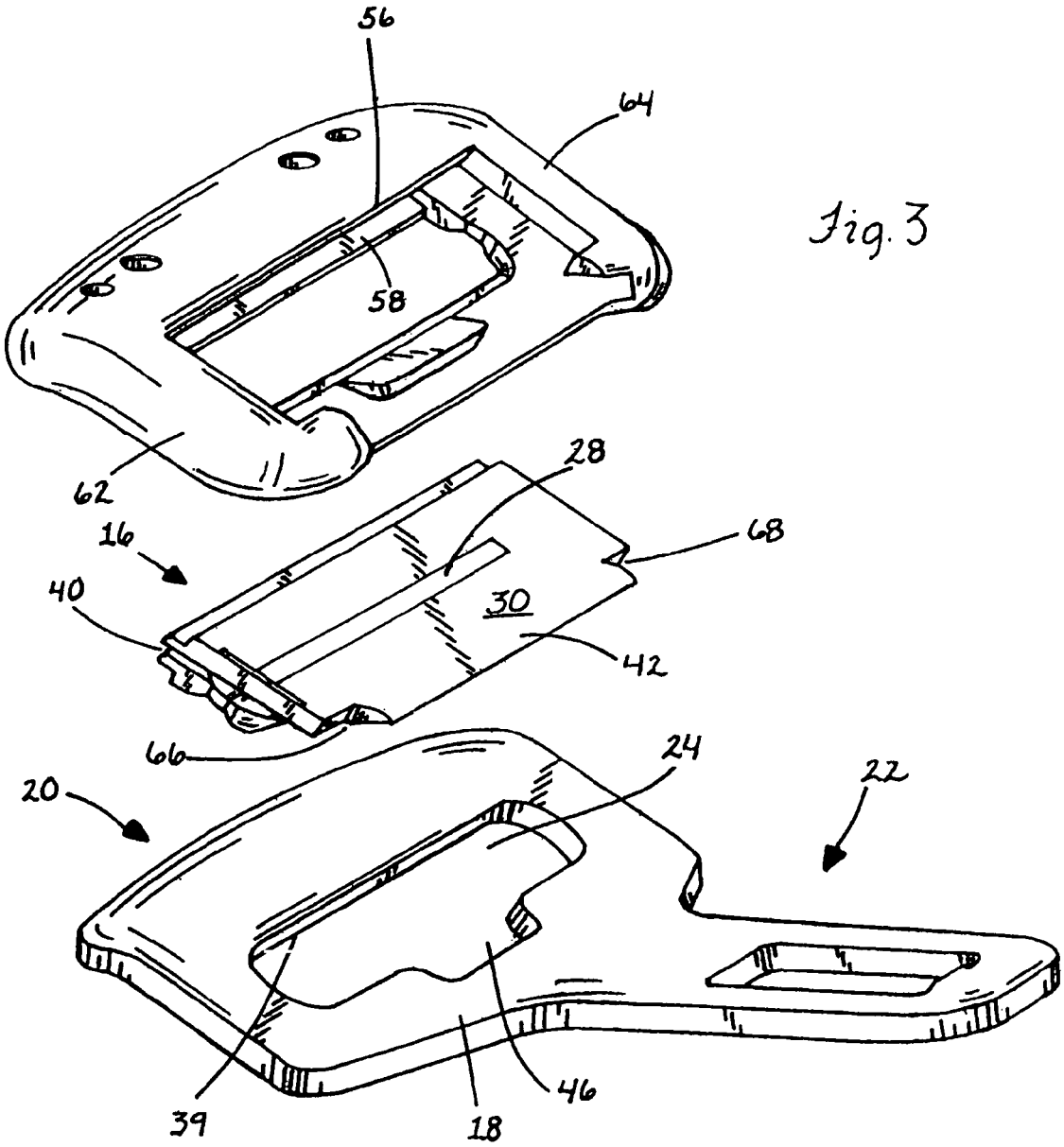
FIG. 3 is an exploded, perspective view of the tongue plate of FIGS. 1 and 2.

In FIGS. 1 and 2, an anti-rattle tongue plate 10 having both hard and soft material thereon is depicted. As seen in FIG. 3, the hard material 12 is fabricated or molded into a hard insert 16 that is a distinct component from the body 18 of the tongue plate 10. On the other hand, the soft material 14 is over molded onto the tongue plate 10. The soft material 14 is over molded onto the tongue plate 10 at predetermined locations so that it presents an impact surface against which internal vehicle components such as hard vehicle trim panels will engage during rough ride conditions in the vehicle. In this manner, the tongue plate 10 is well adapted to reduce noise that would otherwise be created by such repeated engagement between the plate body 18 or the hard material 12 thereon and the trim panel.

Preferably, both materials are moldable materials. The hard material 12 can be a plastic material such as nylon or acetal material. The soft material 14 can be a cushioning material such as an elastomeric or vinyl material. Manifestly, other materials can be utilized for the anti-rattle tongue plates described herein.

The provision of the hard insert 16 is advantageous in that it does away with the need for another insert mold for over molding the hard material 12 to the plate body 18. Instead, the insert 16 can be secured to the plate body 18 in a variety of different ways. For instance, the hard insert 16 can be retained in position on the plate body 18 only for being placed in the insert mold as will be described hereinafter where the soft material 14 is then over molded onto the tongue plate subassembly of the insert 16 and plate body 18 so as to operably connect the two distinct components together. In this regard, the strength of this connection need not be as great as would be required when the insert 16 is subject to loading by the seat belt. Instead, it is the soft over mold material 14 that more permanently bonds and fixes the insert 16 to the plate body 18. Nevertheless, the insert 16 and plate body 18 can include an additional positive connection such as via a press or snap fit of the insert 16 to the plate body 18 so that the over mold material 14 provides additional connection strength rather than being substantially relied upon to permanently hold and fix the retained insert 16 in place relative to the tongue body 18.

Figure 4:
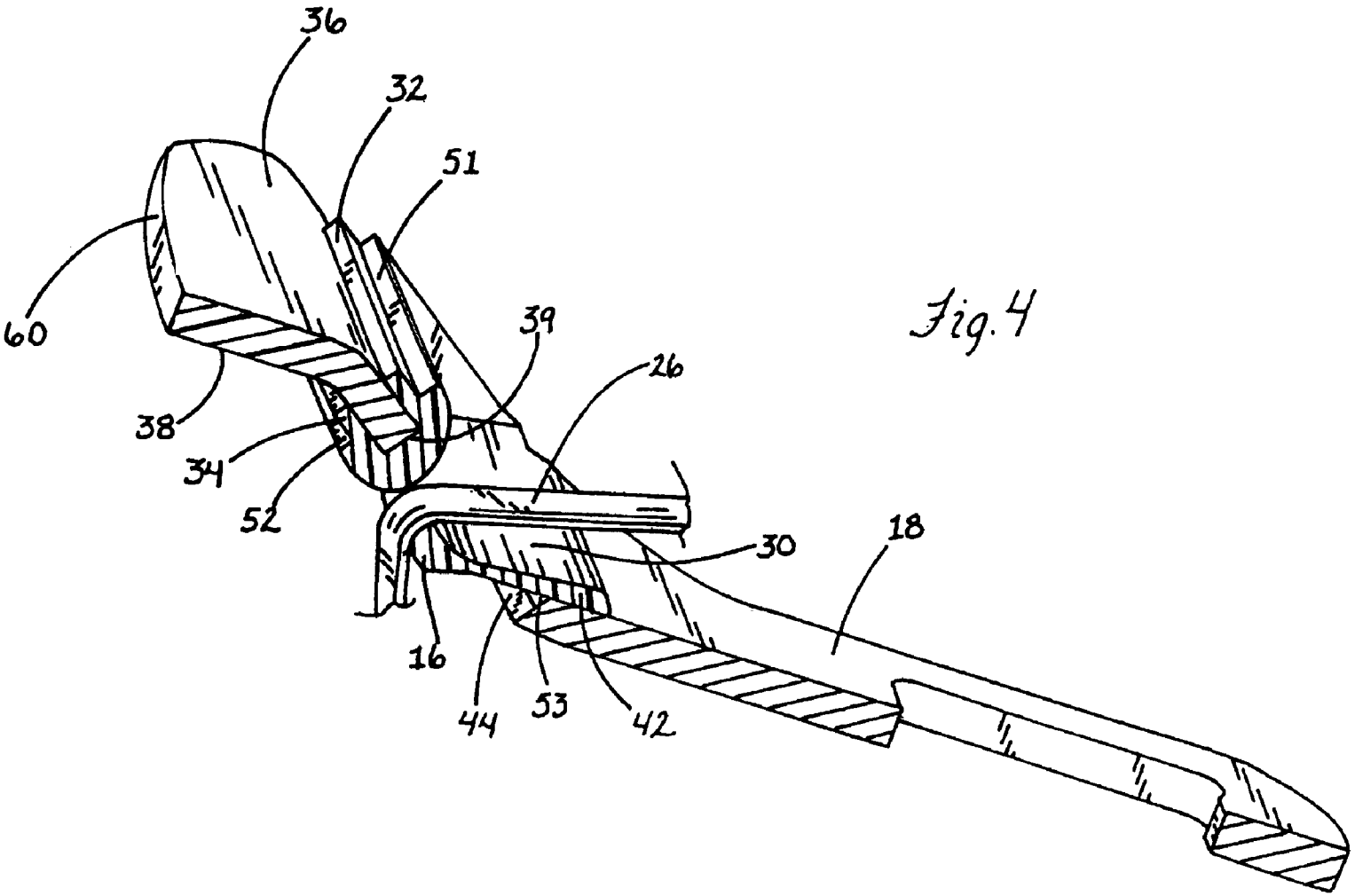
FIG. 4 is a perspective, sectional view of the tongue plate of FIGS. 1-3 showing the hard insert attached to the tongue plate with belt webbing extending through a slot of the insert.

Referring to FIG. 3, the tongue body 18 can be of a metallic material and includes a wide, mounting portion 20 for mounting the tongue plate 10 on a seat belt. The mounting portion 20 has a narrower, projecting portion 22 extending centrally therefrom for being latched in a buckle. As shown, the tongue body portions 20 and 22 extend obliquely to each other so that the tongue body 18 has a bent configuration. Further, the body 18 can have a plate-like construction with a substantially constant thickness. The wide mounting portion 20 includes a laterally extending opening 24 through which seat belt webbing 26 can extend (FIG. 4). The hard insert 16 is configured to be mounted adjacent to and, more particularly, about the opening 24. The insert 16 has a generally rectangular configuration and defines a laterally extending slot opening 28 therein for the webbing 26 to extend therethough, as can be seen in FIG. 4. Thus, the hard insert 16 provides a low friction bearing surface such as at surface portion 30 thereof for the seat belt webbing 26 for relative sliding therebetween.

The insert 16 has flanges 32 and 34 spaced so as to fit closely about the corresponding surfaces 36 and 38 of the wide portion 20 of the plate body 18 at edge 39 that circumscribes the plate body opening 24, as can be seen in FIG. 4. Accordingly, the plate body 18 fits into a groove 40 formed between the insert flanges 32 and 34. The insert 16 also includes a thin extension 42 that projects from one of the long sides of the rectangular insert 16. As can be seen best in FIG. 4, the extension 42 is configured so that with the insert 16 in its operable position relative to the plate body 18, the extension 42 will extend at an incline from the plate opening 24 into engagement on the plate body surface 36. In this manner, there is a wedge shaped gap 44 created below the insert extension 42 in a small extension 46 of the opening 24 in the tongue plate body 18. As can be seen, the extension 46 of the opening 24 is adjacent the projecting or latch portion 22 of the tongue plate body 18. The extension 42 of the insert 18 extends laterally beyond the opening extension 46 and has a recess 48 formed in the surface 30 thereof in the area of the opening extension 46, as shown in FIG. 1. Another detail of the configuration of the insert 16 is that it includes shoulder surfaces 50 and 52 recessed back from the corresponding flanges 32 and 34, as best seen in FIG. 4.

If a press fit between the insert 16 and plate body 18 is desired, a nub projection 53 (FIG. 4) can be formed on the underside of the insert extension 42 so as to be in interference with the edge 39 extending about the plate body opening 24. With the insert 18 press fit to the plate body 18, the nub projection 53 will be slightly deformed so as to bear tightly against the plate body edge 39 and provide a more secure connection and retention of the insert 16 to the plate body 18 prior to application of the soft over mold material 14 on the plate 10. In this instance, the press fit may be made robust enough so that the over mold material 14 need not bond the insert 16 to the plate body 18.

Figure 5:
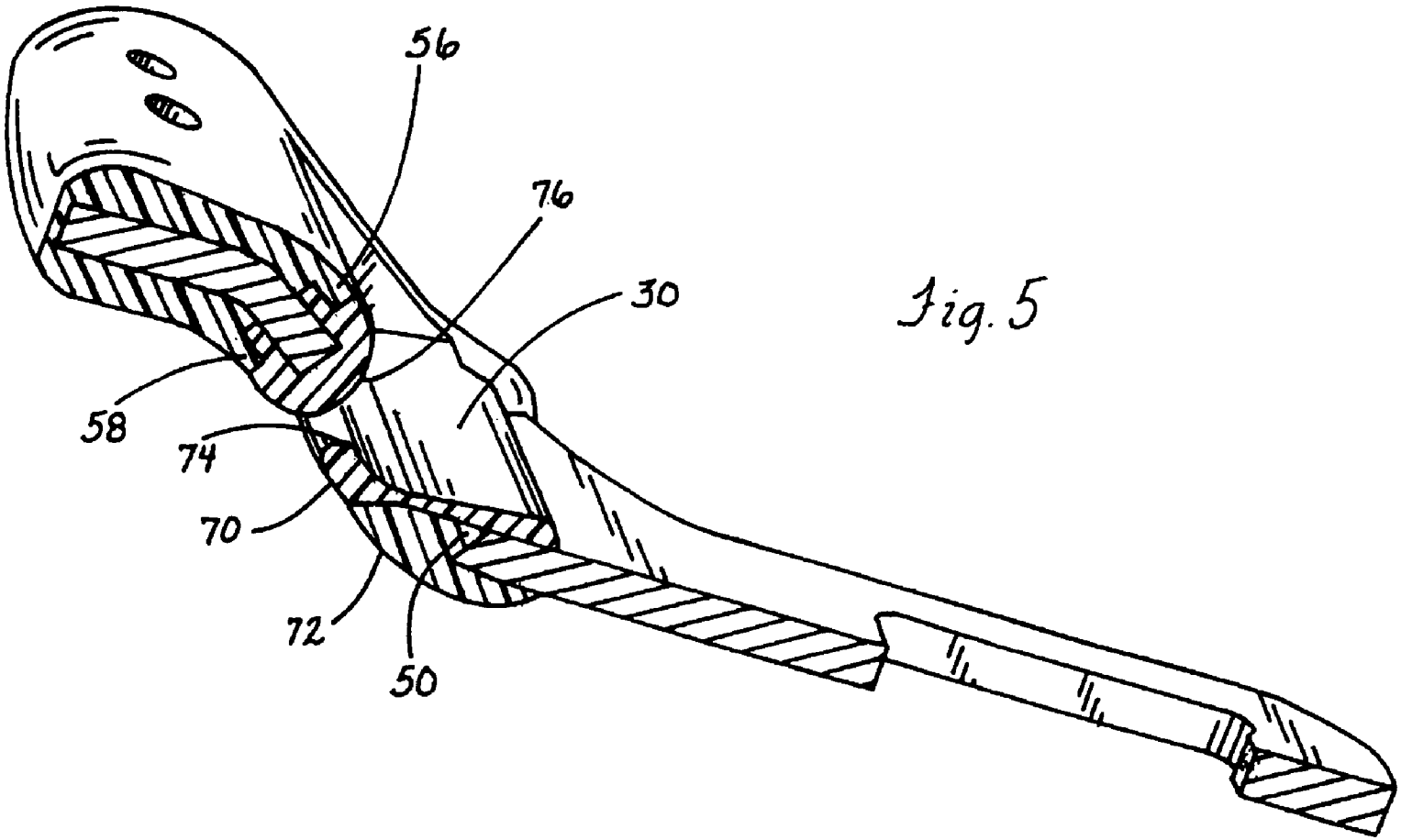
FIG. 5 is a perspective, sectional view similar to FIG. 4 showing the soft, over mold material on the insert and tongue plate body.

Referring next to FIGS. 3 and 5, it can be seen that the soft material 14 preferably is over molded onto the tongue plate subassembly having the insert 16 retained on the tongue plate body 18 in the opening 24 thereof such that the soft material 14 adheres to and forms a complimentary configuration to that of the attached insert 16 and plate body 18. In this manner, the soft over mold material 14 adheres or bonds the insert 16 to the plate body 18 to form a substantially permanent connection therebetween. More specifically, the over mold of soft material 14 includes a wedge portion 50 that fills in the gap 44 so as to extend into the extension 46 of the tongue body opening 24. In addition, the over mold includes thin, stepped lip portions 56 and 58 that fit in complimentary relation to the insert flange portions 32 and 34 and shoulder portions 50 and 52 and along the respective tongue body surfaces 36 and 38 adjacent thereto. From the stepped lip portion 56, the over molded soft material 14 extends along the tongue body main surface 36 away from the insert 16 and around the edge surface 60 that extends around the periphery of the tongue body 18 and between the main surfaces 36 and 38 thereof. The over molded soft material 14 also extends along either lateral side of the insert 16 with side portions 62 and 64 thereof that also extend into notches 66 and 68 formed on either side of the insert extension 42.

As can be seen in FIGS. 1 and 5, the over mold material 14 thus only leaves the hard insert 16 exposed in the area of the tongue body opening 24. Further, the guide surface 30 along insert extension 42 is also exposed on the main surface 36 of the wide portion 20 of the tongue plate body 18 adjacent the narrow, latch portion 22 thereof. The soft material 14 is over molded so as to leave even less of the insert 16 exposed in the tongue body opening 24 on the reverse side along the main surface 38 of the body 18, as can be seen in FIG. 2. On this side of the tongue plate 10, the wedge portion 50 of the over molded soft material 14 extends into the tongue body opening 24 and covers most of the insert 16 the seat. Referring specifically to FIG. 5, the insert 16 has a generally flat exposed surface portion 70 that is flush with surface 72 of the wedge portion 50. The flat surface portion 70 leads to an arcuate surface portion 74 of the insert 16 which, along with opposing arcuate surface portion 76 of the insert 16 cooperate to define the slot opening 28 thereof.

Continuing reference to FIGS. 4 and 5, the arcuate surface portion 74 serves as a guiding surface for the belt webbing 26 as it extends through the slot opening 28. In this regard, it can be seen that the webbing 26 is directed away from the soft material 14 so that it does not engage along the surface 72 thereof. The arcuate surface 74 can have a smaller radius of curvature than the surface 76 for this purpose. Further, the insert extension 42 including the exposed surface 30 thereof covering the over molded soft material 14 thereunder, and specifically wedge portion 50 thereof, also protects the soft material 14 against engagement with the seat belt webbing 26.

Figure 12:
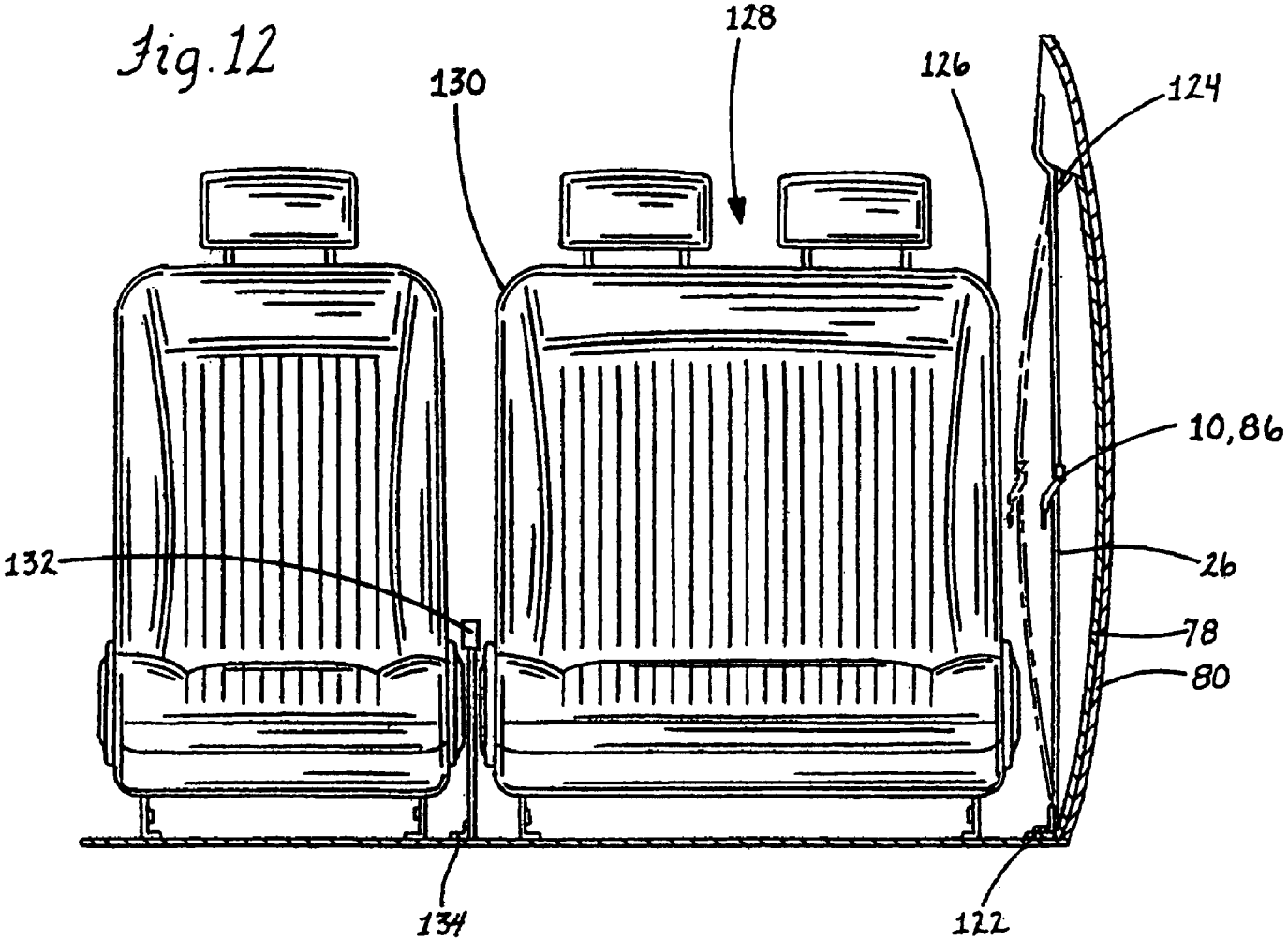
FIG. 12 is an elevational view of a passenger compartment showing an example of a seat belt system with which the tongue plates can be used.

As mentioned, the over molded soft material 14 extends or wraps around the peripheral edge surface 60 from the plate body surface 36 to cover the majority of the surface 38 of the wide portion 20 of the plate body 18, as can be seen in the FIG. 2. As shown, the material 14 forms a generally centrally oriented window opening 76 in which the hard insert 12 and the slot opening 28 thereof are exposed. The over mold material 14 extends generally along the wide portion 20 of the plate body 18 with the plate body projecting portion 22 extending beyond the over mold material 14. Referring to FIG. 12, it can be seen that the tongue plate 10 is typically mounted on seat belt webbing 26 so the surface 38 of the tongue plate body 18 faces the trim panel 78 covering the vehicle pillar 80. The over mold material 14 is disposed on this side of the tongue plate body 18 so that the position closest to the trim panel 78 and most likely to engage therewith during vehicle operation is the arcuate surface 72. In this manner, the over mold material 14 will absorb the impact with the trim panel 78 and reduce any noise generated thereby. Also, should the tongue plate 10 become twisted such as in a 90° orientation to that shown in FIG. 12, the provision of the soft over mold material 14 in wrapped, covering relation to the edge 60 of the tongue plate body 18 along the wide mounting portion 20 thereof will also absorb impacts with the trim panel 78 prior to any potential engagement with the hard insert material 12 or the exposed metal material of the tongue plate body 18 such as along the narrow latch portion 22 thereof.

Figure 6:
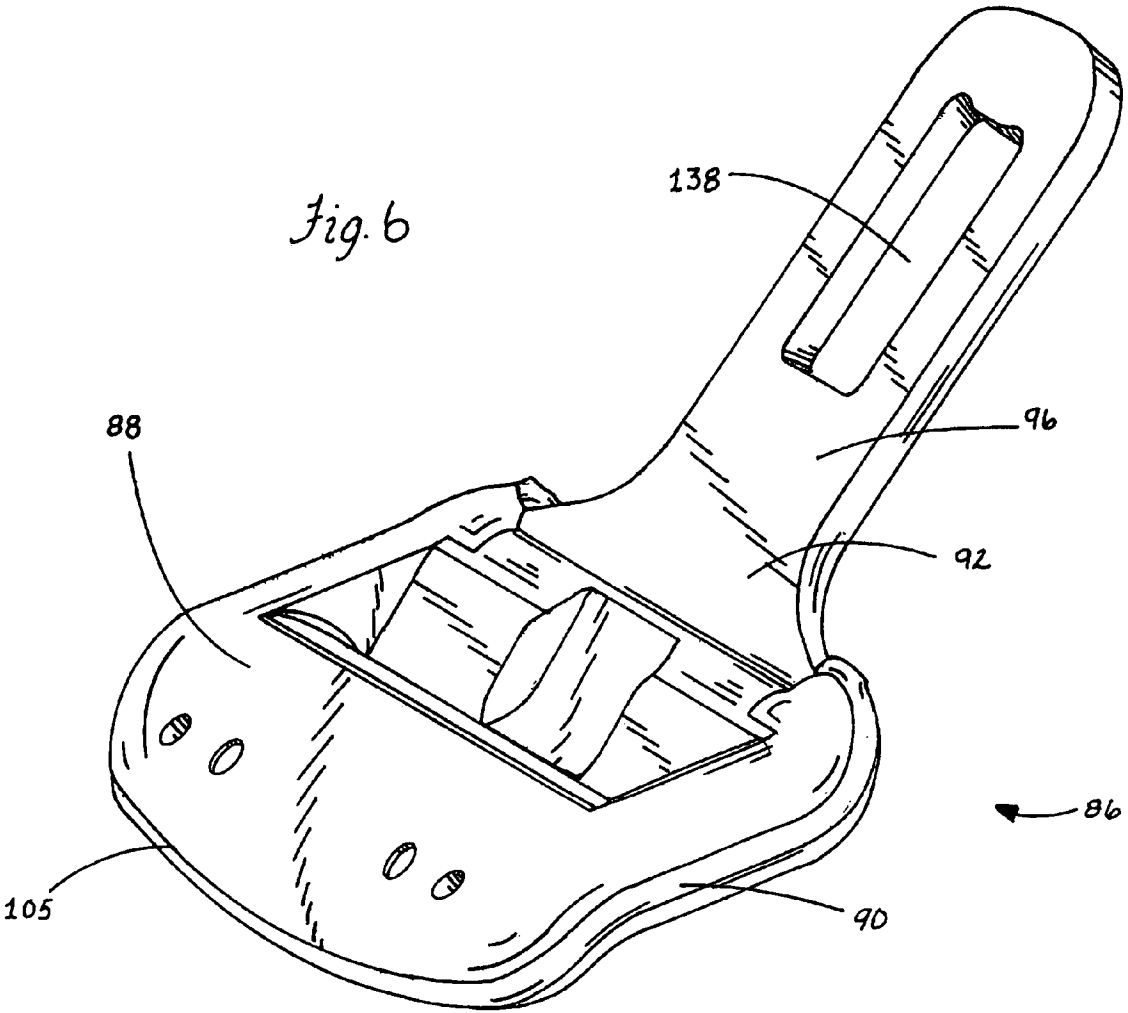
FIG. 6 is a perspective view of an alternative tongue plate in accordance with the present invention showing a hard material over molded onto the plate body and a band of soft material connected thereon.
Figure 7:
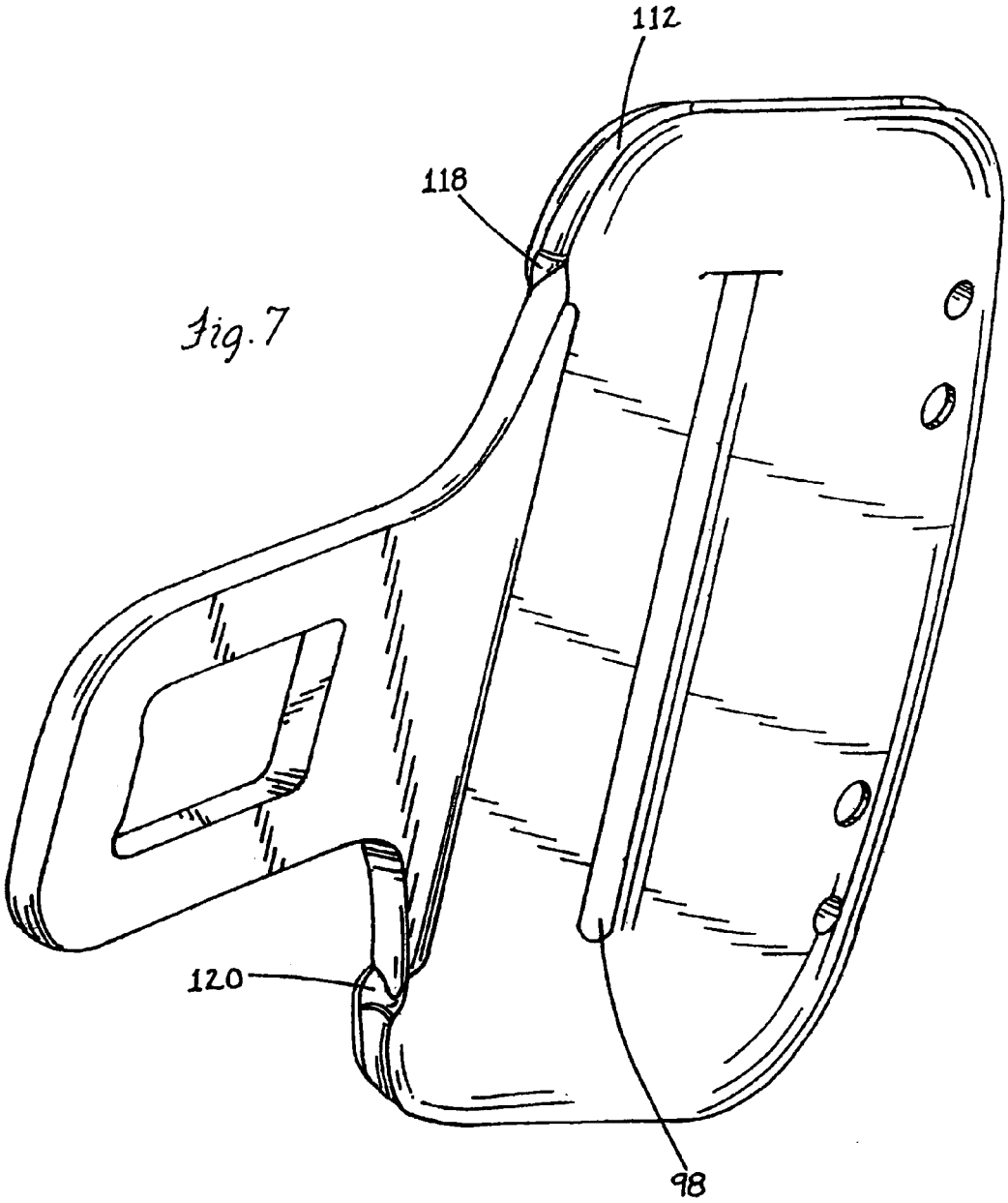
FIG. 7 is a perspective view of the tongue plate of FIG. 6 with the band of soft material removed.
Figure 8:
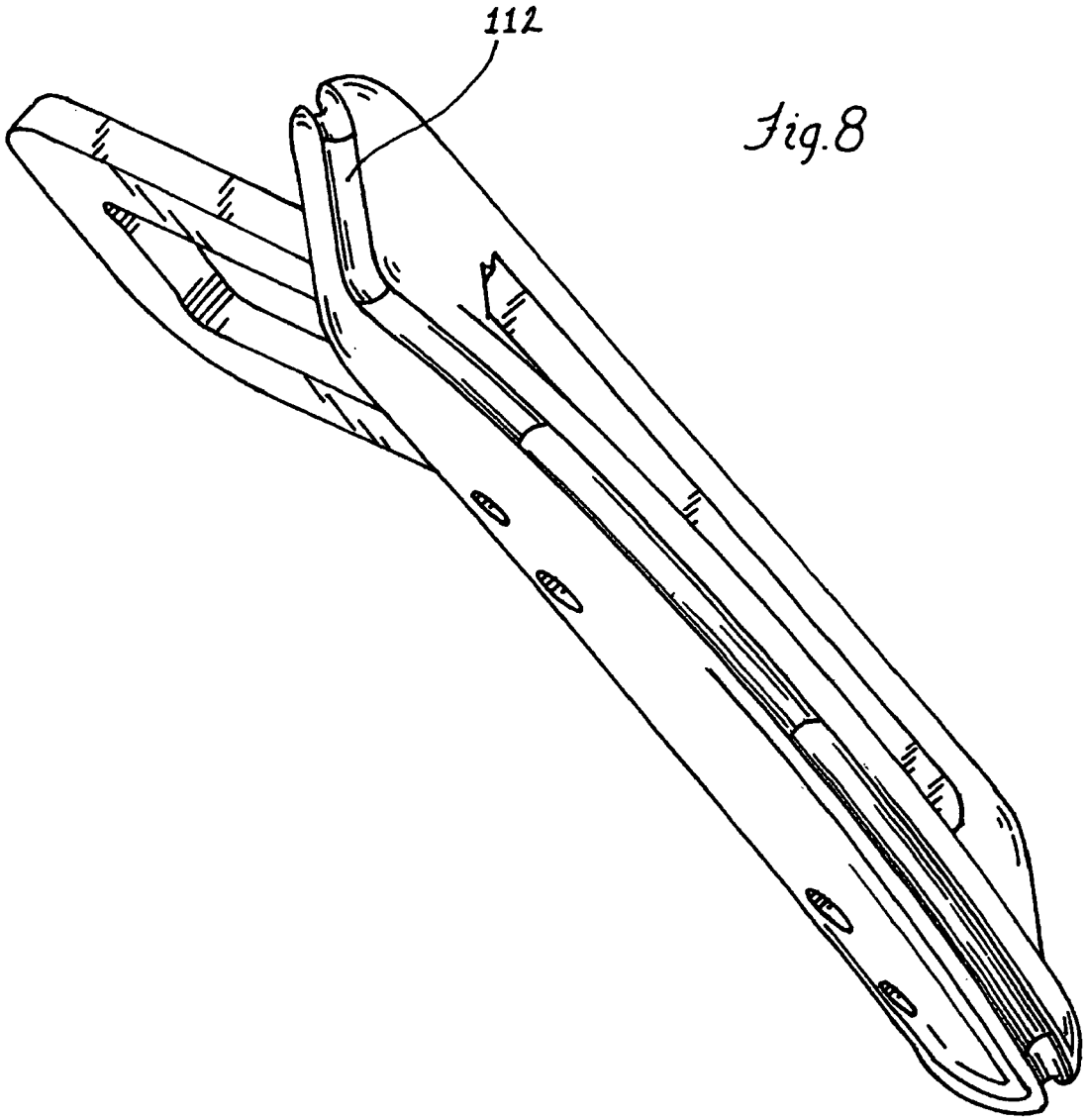
FIG. 8 is a end, perspective view of the tongue plate of FIGS. 6 and 7 showing a groove formed in the periphery of the hard over molded material on the tongue plate body for receipt of the band of soft material therein.
Figure 9:
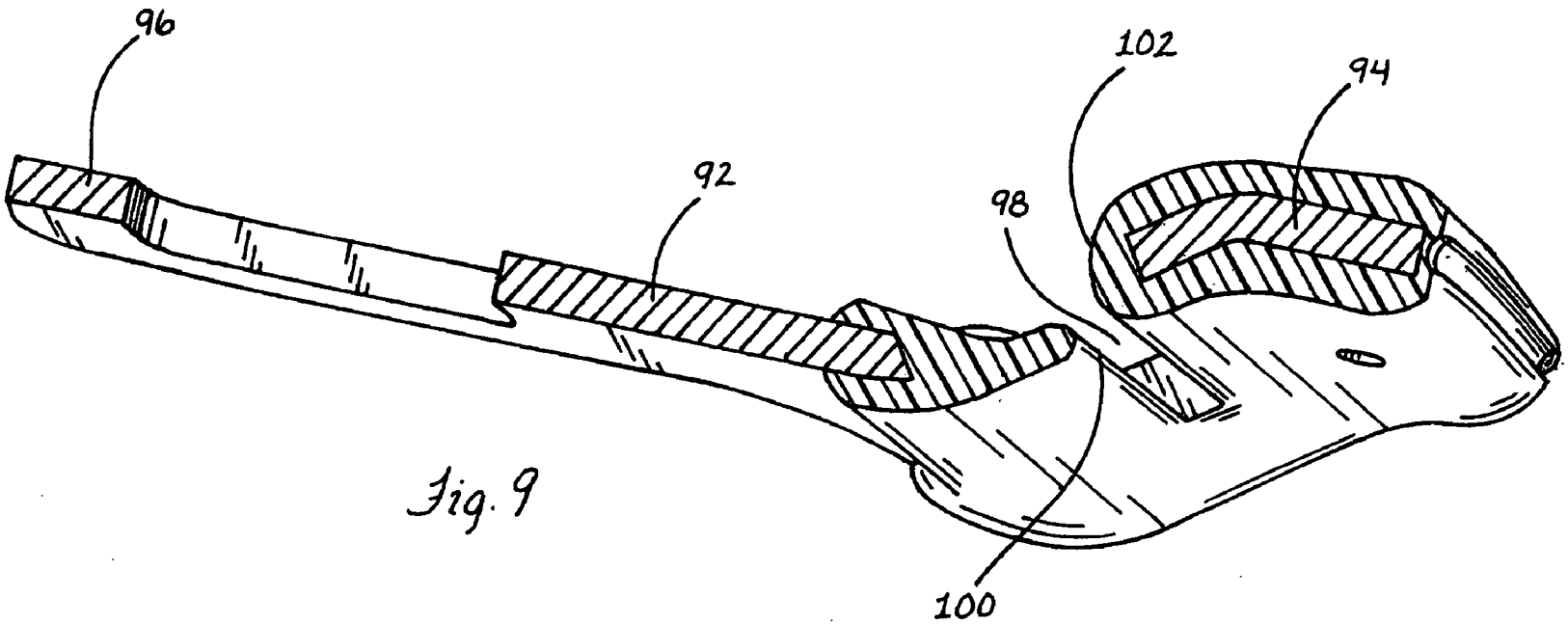
FIG. 9 is a perspective, sectional view of the tongue plate of FIGS. 6-8 showing a belt webbing slot formed by the over molded hard material.

Another tongue plate 86 in accordance with an alternative form of the invention is shown in FIG. 6. The tongue plate 86 also has hard material 88 and soft material 90 operably connected to the body 92 of the plate similar to tongue plate 10. With tongue plate 86, however, it is the hard material 88 that is over molded onto the tongue plate body 92 to adhere thereto, and specifically at the wide, mounting portion 94 thereof at which the tongue plate 86 is mounted to the seat belt webbing 26. A narrow, projecting portion 96 extends centrally from the wide mounting portion 94 and is free from over mold material 88 thereon. The wide portion 94 of the tongue plate body 92 has an opening for the belt webbing 26 to extend therethrough. The hard material 88 is over molded about the body opening to form a slot opening 98 as best seen in FIGS. 7 and 9. The hard material 88 is formed with arcuate surface portions 100 and 102 with the belt webbing 26 primarily bearing against the surface 100 to provide for relatively smooth sliding between the tongue plate 86 and the belt webbing 26.

Figure 10:
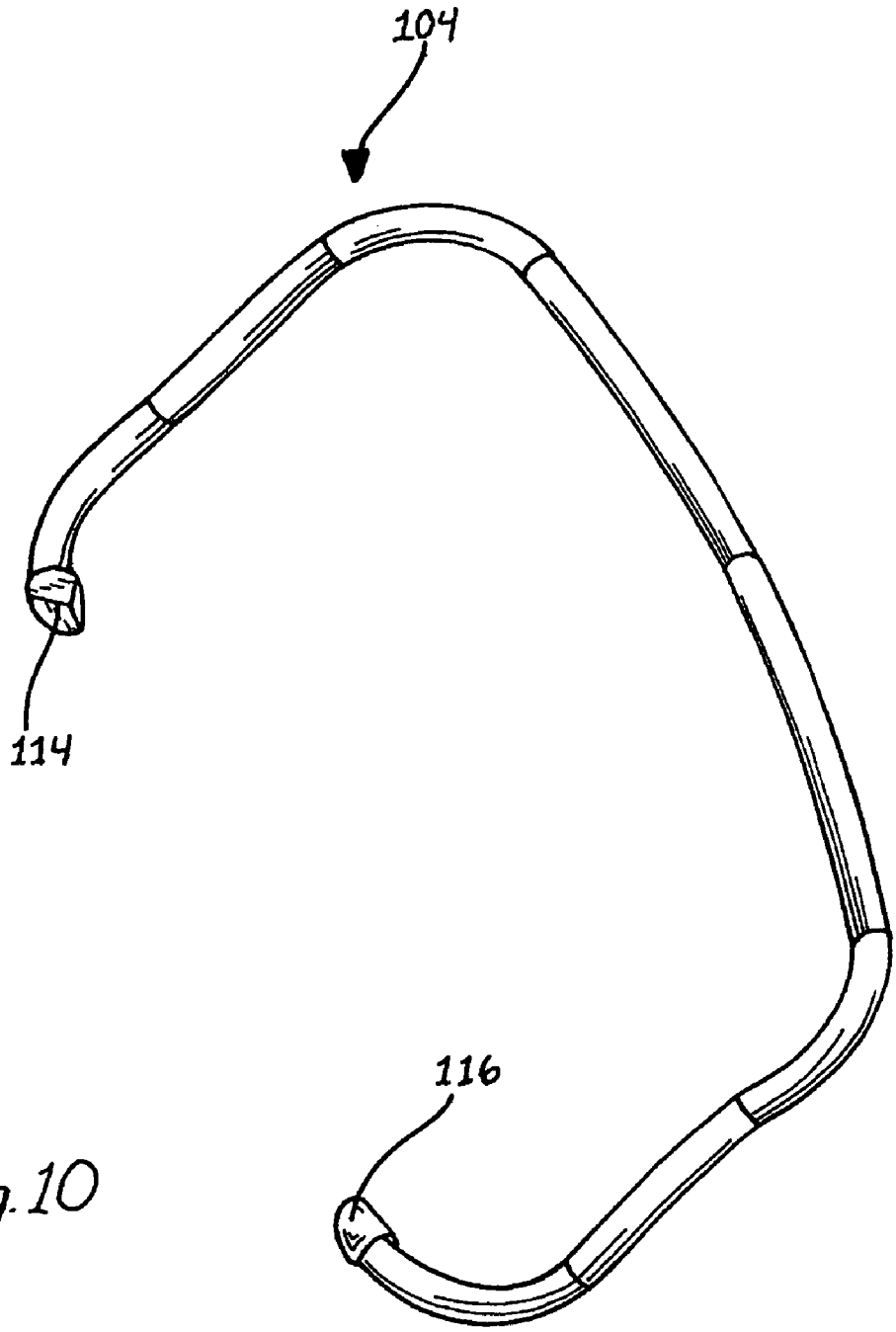
FIG. 10 is a perspective view of the band of resilient material showing enlarged ends thereof.
Figure 11:
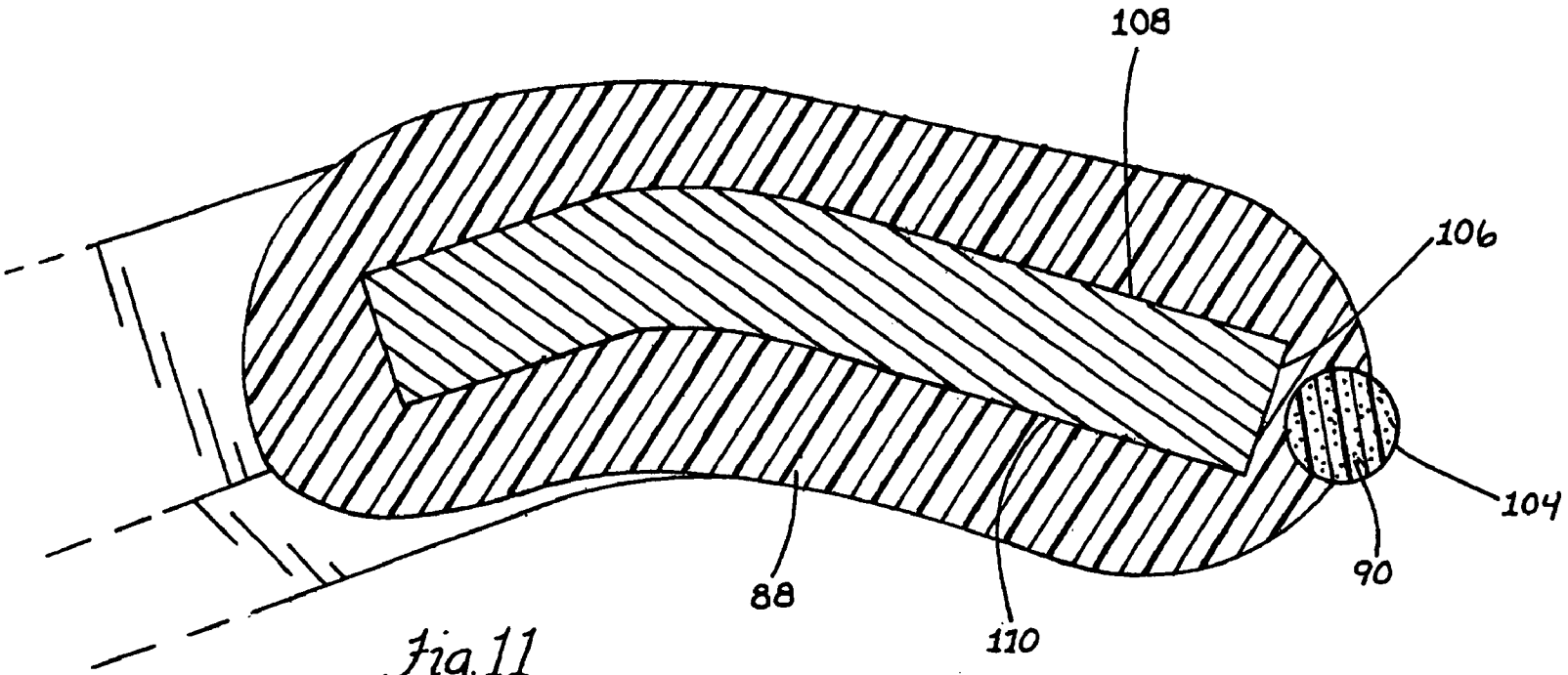
FIG. 11 is an enlarged, cross-sectional view showing the resilient band received in the groove of the hard over mold material.

The separately fabricated component is of the soft material 90 and is in the form of a soft, resilient band or cord 104, as best seen in FIGS. 6 and 10. The band 104 is secured to the over molded hard material 88 around the periphery 105 thereof so as to be generally aligned with edge surface 106 extending between main surfaces 108 and 110 of the plate body 92, as can be seen in FIG. 11. Since the soft material 90 of the band 104 is only raised from the tongue plate 86 about the outer periphery 105 of the wide portion 94 thereof, the tongue plate 86 mainly provides noise reduction when the seat belt system arrangement is such that the webbing 24 and thus tongue plate 86 thereon are oriented to be approximately 90° turned from that illustrated in FIG. 12, such as when the webbing 24 is twisted. To connect the band 104 to the hard over molded material 88, a groove 112 can be formed in the hard material 88 about the periphery 105 thereof. So that the band 104 projects from the groove 112, the thickness or diameter of the band 104 is sized to be greater than the depth of the groove 112, as can be seen in FIG. 11.

As previously mentioned, it is preferred that the band 104 be of a resilient, soft material such as an elastomer so that it can be resiliently retained in the peripheral groove 112. In this regard, the band 104 can have enlarged plug portions 114 and 116 at either free end thereof for fitting in corresponding enlarged socket openings 118 and 120 at the ends of the groove 112. To secure the resilient band 104 to the tongue plate body 92, and more specifically to the over molded hard material 88 thereon, one of the plug portions 114, 116 is inserted into its corresponding socket 118, 120 and the band 104 is then fit in the groove 112 and pulled to stretch the resilient material 90 thereof to fit the other plug portion 114, 116 in the other socket 118, 120. The band 104 then will be resiliently held in the groove 112 via the enlarged plug portions 114 and 116 thereof bearing tightly against the surfaces in the socket openings 118 and 120. Alternatively, the band 104 can utilize an adhesive, or an RTV material, for securing it to the hard material 88, preferably seated in the groove 112 thereof. It should be noted that a groove 112 need not be provided, although such is preferred for secure seating of the band 104 against the over molded hard material 88. Further, the band 104 can have a shape retentive configuration in the form of the illustrated hoop-like configuration of FIG. 10. Alternatively, the band 104 can simply have a substantially straight configuration which is then formed into the appropriate shape when mounted to the hard material 88, and specifically when fit into the groove 112 thereof as described above.

The tongue plate 86 offers similar advantages to the tongue plate 10 in terms of the efficiencies in its manufacture and thus its cost. Since the resilient band 104 is separately fabricated as by molding thereof, the tongue plate 86 only requires a single, insert mold in which the tongue plate body 92 is placed for over molding of the hard material 88 thereon. Thereafter, the separately fabricated bands 104 can be manually or robotically mounted to the tongue plate subassembly including the over molded hard material 88 on the tongue plate body 92 in a relatively quick, easy and straightforward manner, as discussed earlier.

Another alternative providing benefits similar to that of the tongue plates 10 and 86 is to initially over mold soft material onto the tongue plate body, and specifically the wider, mounting portion thereof. The over mold is done so as to leave an area around the opening of the wide portion of the tongue body free of soft material thereabout. A separate hard insert similar to that provided for tongue plate 10 is then press or snap fit or otherwise secured to the over molded soft material and/or plate body.

As is apparent, the hard insert can be molded in a standard injection mold so that only a single, insert mold is necessary for over molding the soft material onto the tongue plate body. This version generates a tongue plate very similar to tongue plate 10 except that rather than over molding the soft material after the hard insert is applied to the plate body, the soft material is initially over molded directly on the plate body with the separately fabricated hard insert connected to the subassembly thereafter.

Turning to more of the details regarding the environment of use of the anti-rattle tongue plates described which, the tongue plates 10 and 86 are mounted via the respective wide mounting portions 20, 94 thereof for free sliding along the belt webbing 24, as limited by a stop (not shown) thereon to position the tongue plates 10, 86 in an elevated, stowed condition, as shown in FIG. 12. The tongue plates 10 and 86 can be part of a standard three point seat belt system, as depicted in FIG. 12. In this regard, there is a lower anchor 122 for the belt webbing, and an upper anchor 124 which can include a guide loop for redirecting the seat belt from the retractor down toward the lower anchor 122. These anchors 122 and 124 are generally positioned along an outboard side 126 of a vehicle seat 128 with which the seat belt 24 carrying the tongue plate 10, 86 is to be used. At the inboard side 130 of the seat, a buckle 132 is anchored at 134 to the vehicle, and is configured for receiving and releasably locking the tongue plate 10, 86 therein via window openings 136 and 138 formed in the respective projecting portions 22 and 96. Manifestly, the tongue plates 10 and 86 can be used with a wide variety of anchoring arrangements. As mentioned, the tongue plate 86 is particularly useful where the anchors, in particularly the lower and upper anchors 122 and 124 are arranged such that the webbing 24 tends to twist along with the tongue plate 86 thereon when the tongue plate is unlatched from the buckle 40 and in its stowed condition. In this instance, it is the periphery of the tongue plate that needs the soft, cushioning material provided by the resilient band 104, as previously discussed.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. An anti-rattle tongue plate comprising:

a plate body having an opening for seat belt webbing to extend therethough;

an over mold that is over molded on the plate body to be directly formed thereon with the over mold comprising one of a first material for being operably connected to the plate body at or adjacent to the opening and a second material that is softer than the first material for being operably connected to the plate body at a predetermined position to absorb impacts for noise reduction; and a component that is formed distinct from the plate body for being operably connected to the plate body after the component has been formed with the component being formed from the other of the first and second materials, wherein the harder first material is exposed in the plate body opening and defines upper and lower edges of a laterally extending slot opening for the seat belt webbing to extend therethrough to provide low friction bearing surfaces along both the upper and the lower edges of the slot opening for smooth sliding of the belt webbing through the slot opening, and wherein the distinct component is a hard insert of the first material, and the over mold is of the second material that is a moldable material that is over molded onto the plate body.

2. The anti-rattle tongue plate of claim 1 wherein the hard insert is retained on the plate body, and the over mold is over molded onto both the plate body and the hard insert.

3. The anti-rattle tongue plate of claim 1 wherein the hard insert is fixedly connected to at least one of the plate body and the over mold.

4. The anti-rattle tongue plate of claim 1 wherein the hard insert and the plate body have a press-fit connection therebetween.

5. A tongue plate comprising:

a body of metallic material including a lower, wide mounting portion having a laterally extending opening therein, and an upper, narrower projecting portion extending centrally and upwardly from the lower, wide mounting portion;

opposite main surfaces of the wide mounting portion through which the laterally extending opening extends;

an insert of hard plastic material for being connected to the body and having a laterally extending slot opening;

an over mold of a soft cushioning material and which is configured so that with the over mold over molded on the wide mounting portion of the body, and the insert connected to the plate body, the insert slot opening extends in the laterally extending opening of the body so that upper and lower edges of the slot opening are of the hard material and are arranged for being engaged by belt webbing extending therethough, and the insert has an extension that extends in the body opening and down along one of the main surfaces from the slot opening lower edge uncovered by the over mold to provide a low friction guiding surface thereon for the belt webbing so that the insert has a greater portion thereof exposed along the one main surface than on the opposite main surface.

6. The tongue plate of claim 5 wherein the insert has no portion thereof that extends along the opposite main surface of the wide mounting portion of the body.

7. A tongue plate comprising:

a body of metallic material including a lower, wide mounting portion having a laterally extending opening therein, and an upper, narrower projecting portion extending centrally and upwardly from the lower, wide mounting portion;

opposite main surfaces of the wide mounting portion through which the laterally extending opening extends;

an outer edge surface extending about the wide mounting portion between the opposite main surfaces thereof;

an over mold of hard material over molded onto the lower, wide mounting portion to extend along both of the opposite main surfaces and around the outer edge surface thereof and forming a slot opening in the laterally extending opening for receiving belt webbing therethrough; and an elongate band of soft, resilient material secured to the over mold material to be generally aligned with the outer edge surface of the body wide mounting portion so that the elongate band extends thereabout to provide cushioning and noise reduction upon impacts therewith, wherein the over mold has a recessed groove therein aligned with outer edge surface of the wide mounting portion sized to receive the elongate band therein.

* * * * *

UNITED STATES PATENT AND TRADEMARK OFFICE

CERTIFICATE OF CORRECTION

PATENT NO. : 8,037,581 B2
APPLICATION NO. : 11/457313
DATED : October 18, 2011
INVENTOR(S) : Gray et al.

It is certified that error appears in the above-identified patent and that said Letters Patent is hereby corrected as shown below:

ON THE TITLE PAGE:

On page 1, column 1, in the section entitled "Related U.S. Application Data (60)", delete "2006" and insert -- 2005 --.

Signed and Sealed this
Twenty-fourth Day of May, 2016

Michelle K. Lee

Michelle K. Lee
*Director of the United States Patent and Trademark Office*